US005301854A

United States Patent [19]

Scobey

[11] Patent Number: 5,301,854

[45] Date of Patent: Apr. 12, 1994

[54] STORING AND DISPENSING CONTAINER

[76] Inventor: Brad Scobey, 6555 Rubio St., Van Nuys, Calif. 91406

[21] Appl. No.: 822,682

[22] Filed: Jan. 21, 1992

[51] Int. Cl.[5] ..... B65H 35/10; B26F 3/02

[52] U.S. Cl. ..... 225/34; 225/37; 225/47; 225/77

[58] Field of Search ..... 225/34, 47, 48, 52, 225/77, 91, 37; 242/55.53

[56] References Cited

U.S. PATENT DOCUMENTS

| | | | |
|---|---|---|---|
| 259,438 | 6/1882 | Thompson | 225/51 |
| 2,748,931 | 6/1956 | Taylor | 225/34 |
| 2,825,451 | 3/1958 | Henry | 225/51 |
| 3,092,294 | 6/1963 | Holcombe | 225/48 |
| 3,144,970 | 8/1964 | Beschmann | 225/48 |
| 3,520,409 | 7/1970 | Gibbs, Sr. | 242/55.53 |
| 3,679,110 | 7/1972 | Stine | 225/47 |
| 4,655,377 | 4/1987 | Orangeo, Jr. et al. | 225/48 |

*Primary Examiner*—Hien H. Phan
*Attorney, Agent, or Firm*—Frank L. Zugelter

[57] ABSTRACT

A storing and dispensing container comprising a carton (10) including opposing end panels (15) having corresponding recesses 25 therein for seating a cutting means (24) which is releasably engageable therein. Slots (16) and pendent slots (56) are included in end panels (15) so that a rod(18)with a roll of paper (20) thereon can be supported in the slots (16), (56). Rod (18) includes an additional length (22) at one of its ends adjacent one of the end panels (15) for mounting a tape dispenser (21) thereon and which is handy for assisting securing paper torn off by the cutter (24) onto an article, box or the like. Carton folds up into a closed mode for storing and carrying one of more rolls of paper (20) therein.

8 Claims, 3 Drawing Sheets 10
11
12
13
14
15
16
18
20
21
24
26
27
28
29
34
35
50
57
59
60
61
62
3

STORING AND DISPENSING CONTAINER

TECHNICAL FIELD

This invention relates to dispensing cartons, and more particularly, to a carton containing one or more rolls of paper dispensable therefrom in web form and a cutting edge for tearing off a web of desired length.

PRIOR ART

Teachings in the prior art, hereby made of record and directed to the class of subject matter into which this invention falls are found in the disclosures of the following U.S. Pat. Nos. 2,861,753; 3,088,641; 3,190,520; 3,237,826; 4,508,587; 4,525,235; 4,588,469; 4,755,254; 4,906,322; and 4,949,617.

SUMMARY OF THE INVENTION

This invention is an improvement in a storage and dispensing carton for tearing off desired lengths of webs of wrapping paper or the like stored within its interior. Interior end flaps forming opposing end panels are provided with opposing aligned slots which support a rod or axle on which a roll of paper is mounted. A foldable flap with a pendent slot aligned with its corresponding opposing slot is included in each end panel and is pocketed between its corresponding interior flap and an exterior flap also forming the corresponding end panel. Each interior end flap and each foldable flap as disposed in its panel includes along its corresponding bottom edge a recess that provides for a releasable engagement of a cutter extending across the width of a back panel for the carton. Its cutting edge is in adjacent proximity to a fold line that separates the back panel from a bottom wall of the carton. An end of the paper roll is inserted between the cutter and the back panel of the carton, and, with the bottom wall front panel and the carton's closing flap extended into a flat apron contiguous to the bottom wall, it is readily pulled out manually to a point where a desired length of paper web is capable of being cut off by the cutting edge of the cutter. Thereafter, the apron is suitable for wrapping the web about gift or other boxes, articles or the like. The rod or axle from which the roll of paper unravels includes a length additional to its length that passes through the paper roll, in order that an adhesive tape dispenser mounted thereon is accessible for use with the torn-off paper web in wrapping such other boxes or articles. The carton is made from a single blank which is readily assembled with the paper roll, its rod or axle, and tape dispenser. In its assembled and closed mode, the carton is hand-carryable from one point to the next, and is adaptable for storing a number of additional paper rolls to the one from which paper is dispensed.

An object of this invention is to provide a novel, simple, relatively light-weight, and manageable carton for dispensing a web of paper therefrom.

Another object of this invention is to provide a carton large enough to store several rolls of wrapping accessory papers or the like in addition to the paper roll being dispensed.

Another object of the invention is to provide a cutter releasably engaging a dispensing carton so that it may be turned in any direction or angle for cutting the paper being dispensed.

A still further object of the invention is to provide an apron in an extended mode for the carton and on which boxes and other articles may be easily wrapped with the web of paper cut by subject matter included in the disclosure of this invention.

A further object of this invention is to provide a carton either flat in its unassembled condition or in its assembled condition with or without paper and/or other items contained therein.

Another object of this invention is to facilitate the wrapping of an article on the carton's apron by utilizing tape mounted on the carton's rod, the tape being readily accessible to but one hand or the other of the user.

These and other objects of the invention and its advantages will become more apparent upon a full and complete reading of the following description, appended claims thereto, and the accompanying drawing comprising three (3) sheets of 5 (five) FIGURES.

DESCRIPTION OF THE BEST MODE FOR CARRYING OUT THE INVENTION

Figures 1, 2:
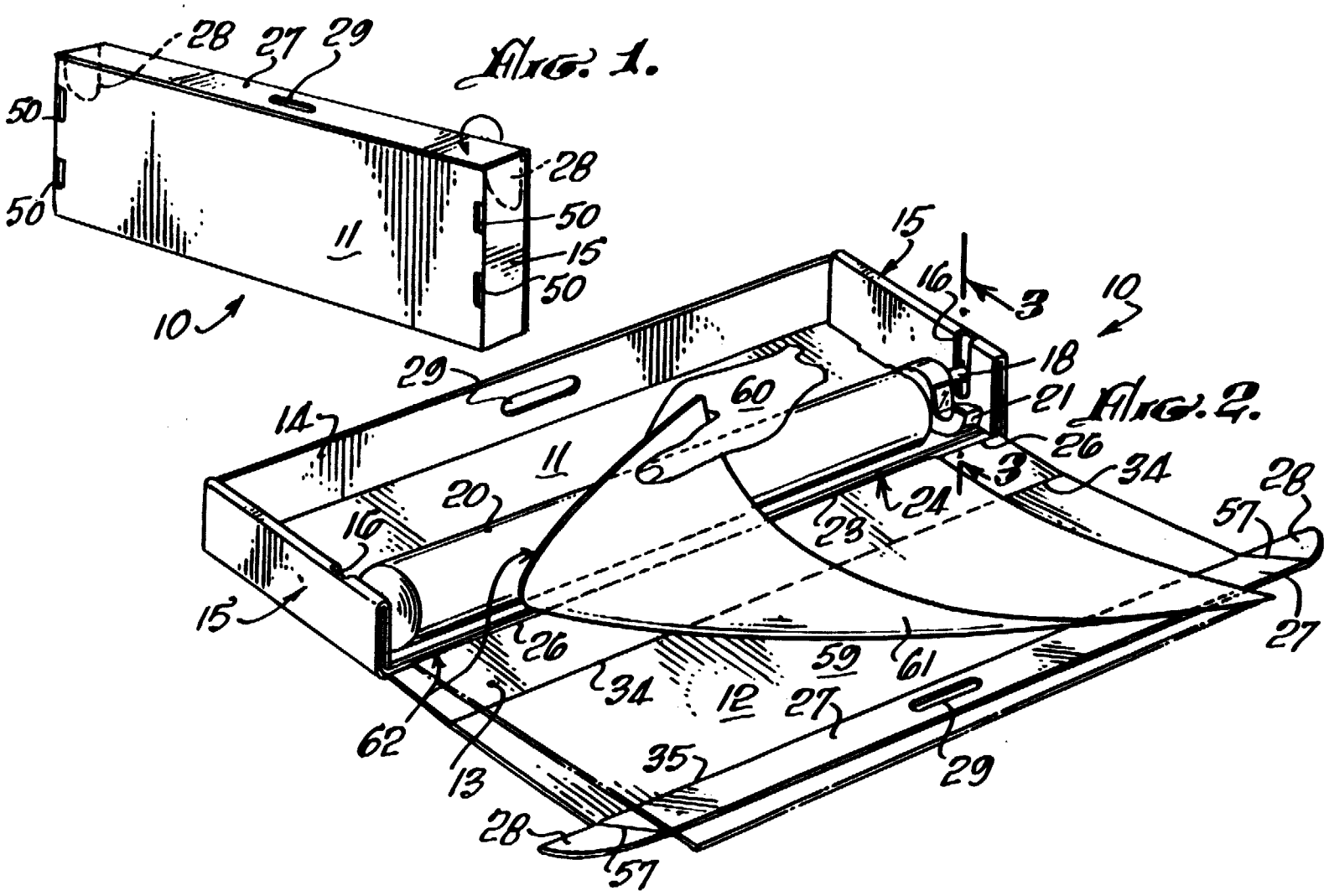
FIG. 1 is a perspective view of a dispensing carton in its closed or storing mode.
FIG. 2 is a perspective view of the carton in its dispensing mode.

Referring now to the drawing wherein reference characters correspond to like numerals hereinafter, FIGS. 1 and 2 illustrate the several features of a dispensing carton 10. Carton 10 comprises a back panel 11, front panel 12, bottom wall 13, a top wall 14, and end panels 15. A slot 16 is formed in each of the end panels 15, FIG. 2. An axle or rod 18 is supported in slots 16, while a roll of paper 20 is mounted on rod 18, along with a tape dispenser 21 disposed on a length 22 (FIG. 3) of rod 18 between the one end of the paper roll 20 and one end of the end panels 15. A cutting bar having a straight or other cutting edge 23 constitutes a cutter 24 that releasably engages or seats on bottom panel 11, via shallow recesses 25 formed in end panels 15, so that its cutting edge 23 lies preferably in proximity to a fold line 26 that separates bottom wall 13 from back panel 11. A flap 27 projects from front panel 12, tongues 28 extending laterally from flap 27 for locking carton 10 in its closed mode. Elongated openings 29 are formed in the top wall 14 and flap 27 so that in the closed mode, they align with one another for a hand which carries the carton.

Figure 5:
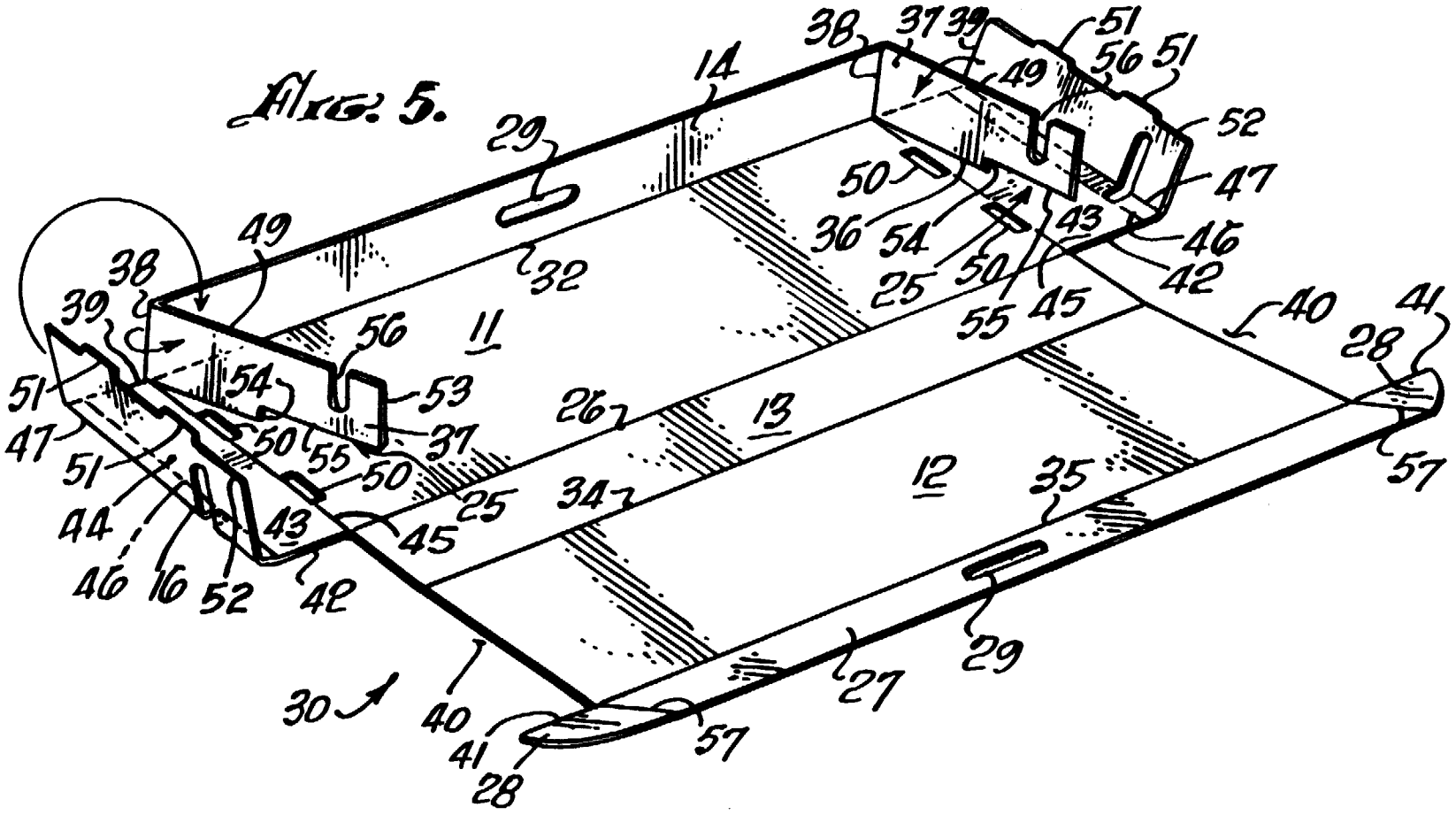
FIG. 5 is a perspective view of a blank in partial assembly towards forming the carton.

Turning to FIG. 5, carton 10 is formed from a blank 30 made of suitable material. Blank 30 is in the form of a single piece that is fabricated into carton 10 by means of cut, scored and fold lines necessary to form the above described elements. In particular, the portions of blank 30 forming elements 14, 11, 13, 12 and flap 27 are creased or scored to provide fold lines 32, 26, 34 and 35, respectively, and which fold lines delineate such elements and flap. In forming each of end panels 15, fold line 32 is cut at its opposite ends so as to provide a bottom edge 36 in each of a pair of terminal flaps 37 produced out of panel 14 by folding it as at 38, while an edge 39, the outcome of cutting fold line 32, remains by such cut.

A section 40 of blank 30 is removed from the lateral end portions of panel 12 and bottom wall 13, FIG. 5, to produce corresponding edges 41 along which corresponding ones of a pair of tongues 28 are formed. Also formed is an edge 42, generally aligned with fold line 26. The portion of blank 30 remaining between corresponding edges 42 and 39 (at each lateral end of panel 11) form an exterior end flap 43 and an interior end flap 44 for carton 10. Each pair of flaps 43, 44 delineate from back panel 11 by means of a fold line 45 generally along which a corresponding flap 37 aligns in the assembly of blank 30 into carton 10. Interior end flap 44 projects from end flap 43 after scoring the latter to form a fold line 46, while a parallel fold line 47 therewith defines a width by which a pocket 48 is formed for flap 37 when assembled in carton 10, its upper edge 49 mating to such width. A pair of spaced cut-out portions 50 are cut and formed in bottom panel 11 adjacent each fold line 45. Tabs 51 are formed in the terminal edge of each interior end flap 44 and mate with corresponding cut-out portions 50 in the assembly of blank 30 to produce corresponding end panels 15 in carton 10. In the formation of tabs 51 a recess 52 is formed in each interior end flap 44 in addition to the portions of flap 44 that are removed to form tabs 51 themselves, in order to accommodate in a releasably engaging manner the end portions of cutter 24.

Each slot 16 is cut out of portions of end flap 44 and end flap 43, and preferably in general parallel alignment with its proximate edge 42. It is to be noted that slot 16 is a closed-ended slot in its formation out of blank 30, however, as assembled in end panels 15, its upper end functions open-endedly to introduce an end of rod 18 therein.

The length of each inwardly folded flap 37 terminates at an edge 53 below which the shallow recess 25 is formed inwardly therefrom, each recess 25 being formed by edges 54 and 55 in order to provide an adjustable position for cutter 24 between walls 13 and 14 and a suitable recess for its thickness. Flap 37's terminating edge 53 need not be in alignment with fold line 26 but may terminate along a line providing a lesser length to flap 37. In the event the length of flap 37 extends beyond slot 16 and towards or to fold line 26, then a pendent slot 56 is formed in each flap 37, hanging from its upper edge 49 downwardly. Each pendent slot 56 is disposed in alignment with its contiguous slot 16, and when its closed or bottom end matches that of its contiguous slot 16, additional support for rod 18 is provided while also providing an open end for introduction of the rod.

Each slot 16 accommodates, in the assembled carton 10, its corresponding end of axle or rod 18 on which the roll of paper 20 being dispensed is mounted. Each of the tongues 28 is formed by the cut-out of a corresponding section 40 in blank 30, with scoring to produce fold lines 57 to provide ease of foldability for tongues 28 in the closing of carton 10. Fold lines 57 are seen to be in alignment with corresponding fold lines 45.

Figures 3, 4:
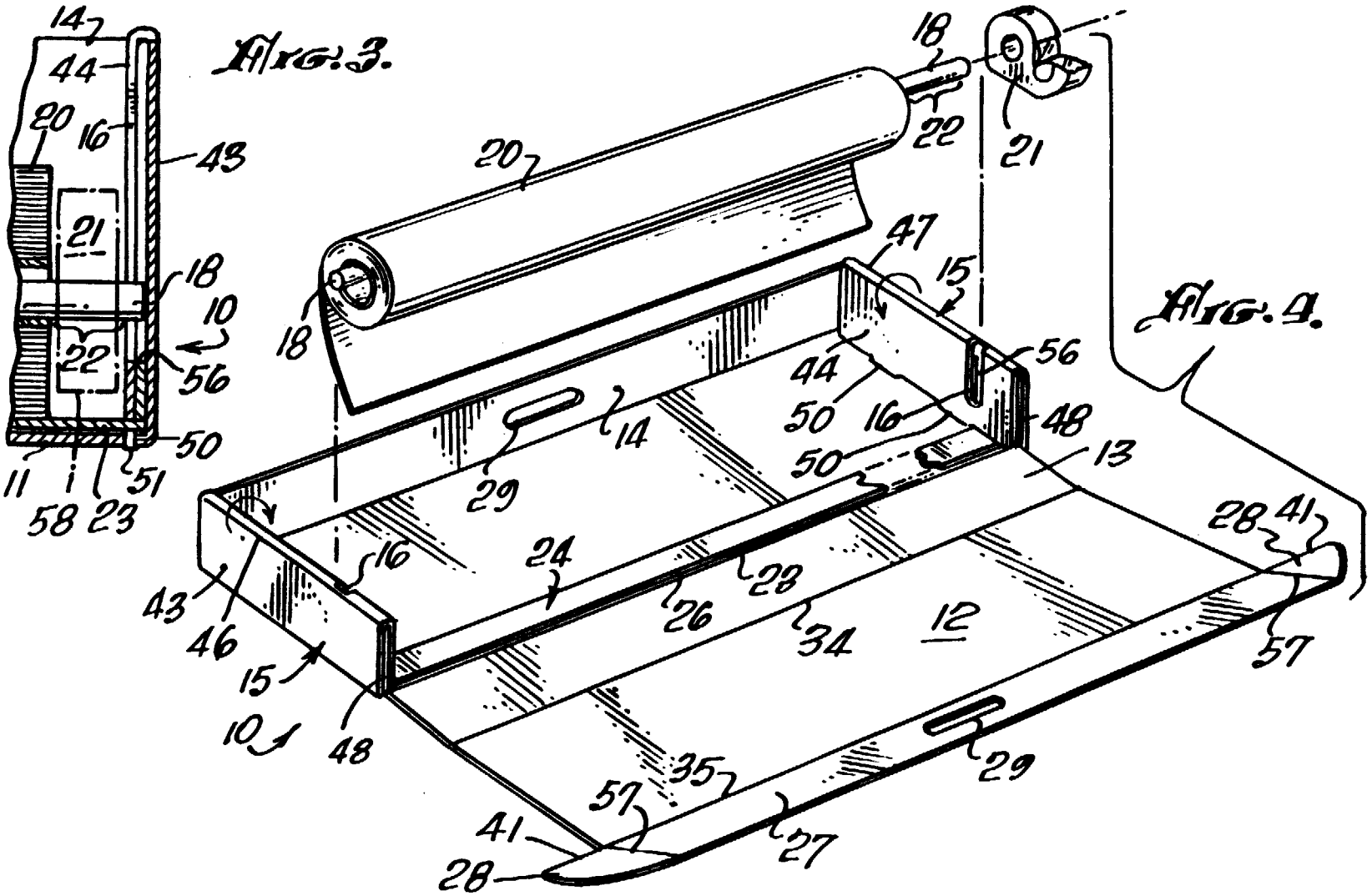
FIG. 3 is a view taken on line 3—3 of FIG. 2.
FIG. 4 is an exploded perspective view of the dispensing carton.

In the assembly of blank 30 into carton 10, FIGS. 5 and 4, flaps 37 are first folded along fold lines 38, with folding then of fold line 32 to thereby swing flap 37 into alignment with fold lines 45. Thereafter, end flaps 43, 44 are swung upwardly about fold lines 45. The blank 30 between each pair of folds 46, 47 is swung over and mated to a corresponding edge 49, this providing more support to rod and paper. Thereafter, each interior end flap 44 is swung downwardly for insertion of its spaced tabs 51 into their corresponding cutout portions 50. In this manner then, end panels 15 are formed, and the slots 16 for rod 18 are in a position to accept it. A paper roll 20 is first mounted upon rod 18, along with a tape dispenser 21 on its additional length 22, FIG. 3, at its one end. The ends of such rod 18 then are inserted into the now open-ended portions (in, pocket 48) of their corresponding slots 16. The end portions of cutter 24 may be inserted within recesses 52 and 25 either before or after installation of rod and paper. Preferably, the length of each recess 52, 25 is such that upon introduction of cutter 24 thereinto, its edge opposing straight or cutting edge 23 abuts its contiguous tab 51 and/or recess edge 55 in each flap 37, FIG. 5, so that edge 23 is stable or otherwise capable of being held in position to cut paper. Preferably, edge 23 aligns with fold line 26. Dispenser 21 is mounted to rod 18 prior to the latter's insertion into slots 16. Slots 16 preferably are sufficiently deep, FIG. 3, in order to accommodate the seating or resting of the base 58 of dispenser 21 on bottom panel 11, FIG. 3. With roll and dispenser now in their positions, bottom wall 13 and front panel 12 are closed upon end panels 15, while flap 27 curls around to engage top wall 14, and tongues 28 are introduced into frictional fits in a pocket formed between corresponding flaps 37 and exterior end flaps 43, therby placing carton 10 in a closed mode.

In operation, tongues 28 are removed manually from such frictional engagement, and flap 27, front panel 12 and bottom wall 13 are swung around down onto a table (not shown) to form a flat apron 59, FIG. 2, on which subsequent wrapping work may be conducted. The hand 60, FIG. 2, feeds a web 61 of paper under cutter 24 and over back panel 11, pulling it forwardly across apron 59 until a desired length of web 61 has been reached. At this point, as cutter 24 is held down by another hand (not shown), hand 60 grasps the paper web and tears it, as at 62, FIG. 2, from cutting edge 23 of cutter 24. Thus, the web 61 of paper is ready for wrapping about an article or other box (not shown) setting on apron 59, with tape dispenser 21 readily available as an assist with tape for the wrapped paper.

An advantage in this construction is that cutter 24 is releasably removable from recesses 52, 25, and thereafter, prior to or after tearing of paper from its roll, turned in any direction or into any angle not square to the width of the paper roll, more than one being possible in one operation, on web 61 on apron 59, so that a desired configuration of paper may be 21 cut other than one cut squarely across the roll's width as illustrated in FIG. 2.

Corrugated cardboard has been found to be a most suitable material for the carton, however, it may be made out of other materials such as plastic or wood, but preferably something which contains a characteristic of rigidity thereto. The cutter preferably is a strip of spring metal. The rod may be made of wood, metal or plastic. The tape dispenser is of a type readily available in the marketplace.

Various modifications and changes may be made within and not departing from the scope and spirit of the invention. Added length 22 on rod 18 need not be included. Rod 18 may be supported by the bottom of a slot 16 that is at a level wherein a point or line on a maximum diameter of a paper roll for the size of carton 10 does not coincide with back panel 11. The shallow recess 25 may be omitted in its cardboard material. Flaps 37 may terminate short of slots 56, thus eliminating such pendent slots. The concept also envisions use of a plurality of rolls, rods, and slots in carton 10 for storing and dispensing different webs of paper that may be the same or that may be distinct one to the next, without the need of changing paper rolls and rolls in relation to only one pair of slots. Base 58 of tape dispenser 21, FIG. 3, depending upon the size of the tape dispenser, may or may not always seat on back panel 11.

INDUSTRIAL APPLICABILITY

This invention is useful in the gift-wrapping arts, although not limited to the use therein.

I claim:

1. In a carton assembly with an interior for a roll of material to be cut, the carton of the assembly including facing end panels having edges and slots therein, the slots for supporting a rod on which a roll of material is mountable, a top wall, a bottom wall joining with a back panel and a front panel by fold lines, and a cutter having a cutting edge, an edge opposing the cutting edge, and end portions, the improvement comprising the cutter releasably mounted in its position on the back panel substantially at the one of the fold liens that joins the bottom wall to the back panel, the end portions of the cutter fitting under edges of the end panels that are secured to the back panel, the bottom wall and the front panel abutting the end panels when the assembly is in a closed position and extending from the back panel and away from the end panels thereby forming an apron for a web of material to be cut by the cutter when the assembly is in an open position.

2. In the improvement of claim 1, the end panels including recesses along their edges that are secured to the back panel, the end portions of the cutter disposed in such recesses, the recesses being formed with an edge for stabilizing the cutter in its releasably mounted position.

3. The improvement of claim 2 including a rod for the roll of material, the rod being mounted in the slots, the rod including a length in excess of the width of the roll of material to be mounted thereon for the mounting of a tape dispenser thereon.

4. The improvement of claim 3 wherein the carton's interior extends beyond the end panel slots to the top wall for storing one or more additional rolls of material.

5. The improvement of claim 2 wherein the carton's interior extends beyond the end panel slots to the top wall for storing one or more additional rolls of material.

6. The improvement of claim 1 including a rod for the roll of material, the rod being mounted in the slots, the rod including a length in excess of the width of the roll of material to be mounted thereon for the mounting of a tape dispenser thereon.

7. The improvement of claim 6 wherein the carton's interior extends beyond the end panel slots to the top wall for storing one or more additional rolls of material.

8. The improvement of claim 1 wherein the carton's interior extends beyond the end panel slots to the top wall for storing one or more additional rolls of material.

* * * * *